US006311336B1

(12) United States Patent
Gootrad

(10) Patent No.: US 6,311,336 B1
(45) Date of Patent: Nov. 6, 2001

(54) STRAPPED DEVICE, GARMENT AND CAP HAVING AT LEAST ONE WATERPROOF POCKET FOR CARRYING ARTICLES

(76) Inventor: Kevin Gootrad, Dearborn Station, #356, 47 W. Polk St., Chicago, IL (US) 60605

( * ) Notice: Subject to any disclaimer, the term of this patent is extended or adjusted under 35 U.S.C. 154(b) by 0 days.

(21) Appl. No.: 09/334,711

(22) Filed: Jun. 16, 1999

(51) Int. Cl.[7] ..... A41D 27/20

(52) U.S. Cl. ..... 2/251; 150/107; 224/257; 224/603

(58) Field of Search ..... 2/207, 300, 309, 2/310, 338, 247, 251; 150/107, 110; 224/153, 257, 600, 601–603, 623, 205–206; D3/218

(56) References Cited

U.S. PATENT DOCUMENTS

D. 238,977 * 2/1976 Burthey ..... 224/602
D. 315,825 * 4/1991 Hutton et al. ..... D3/32
2,672,263 * 3/1954 Alber ..... 224/602
3,931,917 * 1/1976 Zellmer ..... 224/5
4,126,256 * 11/1978 McGruder ..... 224/45
4,634,031 * 1/1987 Frankhouse ..... 224/205
4,687,036 * 8/1987 Thomas ..... 150/118
5,203,482 * 4/1993 Puff ..... 224/257
5,575,004 * 11/1996 Eisele et al. ..... 2/1
5,816,464 * 10/1998 Seiler ..... 224/615
5,862,526 * 1/1999 Longcor et al. ..... 2/338

* cited by examiner

*Primary Examiner*—John J. Calvert
*Assistant Examiner*—Katherine Moran
(74) *Attorney, Agent, or Firm*—Patents + TMS, P.C.

(57) ABSTRACT

A garment and a device are provided having at least one pocket attached to the garment or device accessible via a zipper or other fastener that provides access to another interior compartment formed by the pocket as well as a method for providing a garment or device with a waterproof compartment. The fastener is preferably a waterproof zipper that is attachable via a process requiring the pocket and the zipper to be attached by of gluing, stitching and/or heat-sealing the same. As a result, a completely watertight and waterproof pocket is formed allowing the user of the garment or the device to carry therein items that typically may not be exposed to water.

9 Claims, 6 Drawing Sheets

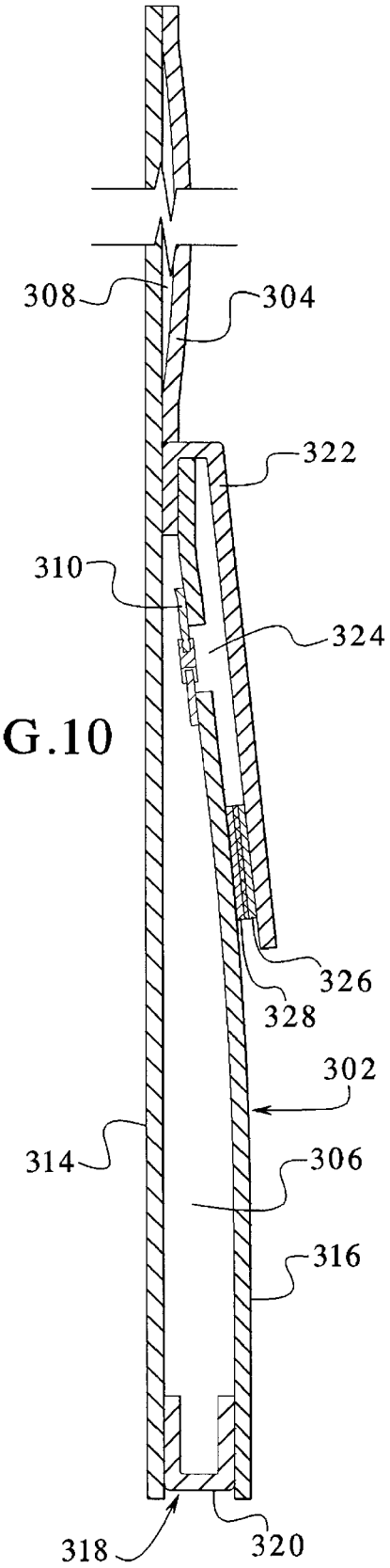
FIG.10
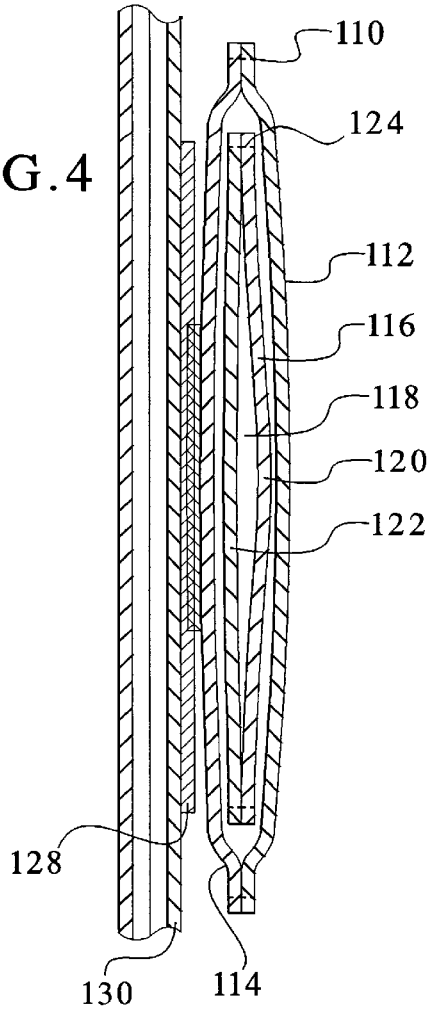
FIG.4
FIG.14
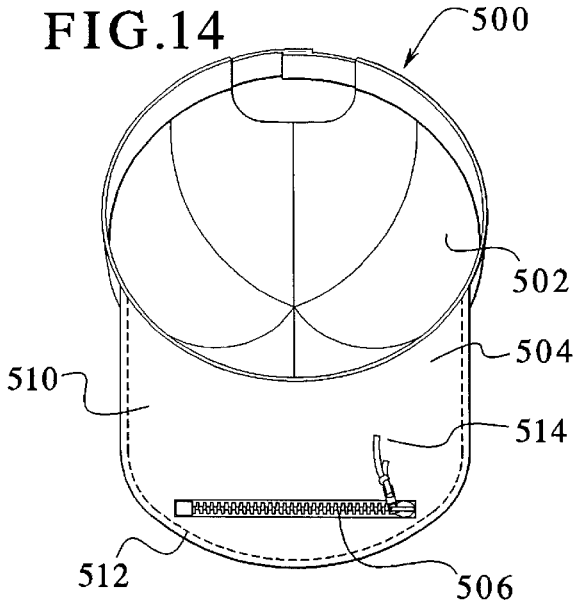

STRAPPED DEVICE, GARMENT AND CAP HAVING AT LEAST ONE WATERPROOF POCKET FOR CARRYING ARTICLES

CROSS REFERENCE TO RELATED APPLICATIONS

This application is related to U.S. patent application Ser. No.: 09/318,413, filed May 25, 1999 and is further related to Applicant's U.S. patent application Ser. No.: 09/334,703 filed concurrently with this application, entitled "A GLOVE AND POCKETED ACCESSORY EXTENSION MEMBER AND A METHOD FOR MAKING THE SAME", the disclosures of which are incorporated herein in their entireties.

BACKGROUND OF THE INVENTION

The present invention generally relates to a pocketed garment or device, particularly for use in water-related activities. More specifically, the present invention relates to a garment or device including one or more pockets that are waterproof to the exterior environment such that an individual wearing the garment or device may store articles within the pocket without risk of damage to the articles contained therein. The present invention further relates to a method for making such a garment or device with waterproof pockets.

It is, of course, generally known to provide a variety of garments or devices for use in water-related activities, such as swimming, water-skiing, snorkeling, scuba diving, boating, surfing and the like. Individuals engaging in activities in an around the water often carry a number of articles with them. Some of those articles may be electronic in nature and cannot be subjected to certain conditions, such as exposure to, contact with, or immersion in water. Accordingly, these objects, such as cellular telephones, pagers, portable electronic organizers, radios, tape players, compact disk players and the like cannot typically be brought into the water due to the risk of exposure to the components which likely results in damage to the device.

A need, therefore, exists for a garment or a device that allows an individual to bring into the water components typically endangered by immersion or otherwise subjected to water without risk of damage to the device or its components as well as a method for providing such a garment or device.

SUMMARY OF THE INVENTION

The present invention generally relates to a garment or a device typically for use in or around the water. More specifically, the present invention relates to a garment or a device having one or more pockets that are capable of holding articles in a watertight and waterproof manner. Still further, the present invention relates to a method for making such a garment or device with waterproof pockets.

To this end, in an embodiment of the present invention, a strapped device is provided. The strapped device has a body that has a first layer and a second layer. The first layer is secured to the second layer. An accessible opening is formed between the first layer and the second layer. A fastener provides selective access to the opening wherein the fastener and the body are constructed to maintain the opening watertight when the fastener is in a closed position.

In an embodiment, a strap is associated with opposite ends of the body. A fastener is associated with the strap to selectively secure the strap.

In an embodiment, the fastener may be a zipper.

In an embodiment, the fastener extends substantially an entire length of the body on the first layer.

In an embodiment, a second accessible opening is formed between the first layer and the second layer. A second fastener is associated with the second accessible opening providing selective access to the second accessible opening.

In an embodiment, a plurality of accessible openings is formed between the first layer and the second layer. A fastener is associated with each one of the plurality of accessible openings providing selective access to the plurality of accessible openings.

In an embodiment, a second fastener has one portion attached to a back side of the second layer, and another portion is attached to a front side of the first layer. The portions are complementary allowing selective and adjustable mating of the back side of the second layer to the front side of the first layer.

In an embodiment, a flap extends from the front side of the first layer and covers the fastener to the accessible opening.

In an embodiment, the body is constructed from neoprene.

In an embodiment, a pocket is formed of a first layer and a second layer within the accessible opening.

In another embodiment of the present invention, a cap is provided. The cap has a body portion that has an opening defining an area securable around a head of an individual. A bill extends from the body portion, and an accessible opening is associated with the bill. A fastener provides selective access to the opening.

In an embodiment, the fastener is a zipper.

In an embodiment, the bill is made from a first layer and a second layer of material. The material of the first layer and the second layer may be neoprene.

In another embodiment of the present invention, a strapped device for carrying articles is provided. The device has a body that defines a length between a first end and a second end. The body is constructed of at least a first layer and a second layer of material. The first layer and the second layer are secured substantially around their peripheries to create an interior compartment between the first layer and the second layer inside the peripherally secured area. A fastener is attached to the first layer to provide selective access to the interior compartment. The interior compartment is waterproof and watertight when the fastener is in a closed position.

In an embodiment, a strap is attached to each of the first end and the second end of the body. Each of the straps has one portion of a complementary matable fastener.

In an embodiment, a second interior compartment is provided between the first layer and the second layer of the body. A second fastener provides selective access to the second interior compartment.

In an embodiment, the first layer and the second layer are constructed from neoprene.

In an embodiment, the first layer and the second layer are secured to each other by an adhesive, a stitch and heat-sealable tape.

In an embodiment, the fastener is attached to the first layer by an adhesive, a stitch and heat-sealable tape.

It is, therefore, an advantage of the present invention to provide a garment or device and a method for providing a garment or device that is suitable for use in and around the water.

Another advantage of the present invention is to provide a garment or a device and a method for providing a garment or device having one or more pockets for holding articles.

Yet another advantage of the present invention is to provide a garment or device and a method for providing a garment or device having one or more pockets that maintain a waterproof and watertight environment for articles carried within the pockets.

And, another advantage of the present invention is to provide a garment or a device and a method of providing a garment or device that is suitable for use in and around water and having pockets associated with the garment for carrying articles that typically cannot be exposed to water.

A still further advantage of the present invention is to provide a garment or a device and a method of providing a garment or device that is simple to manufacture.

Another advantage of the present invention is to provide a garment or a device and a method of providing a garment or device for use in and around water that is durable.

Still further, an advantage of the present invention is to provide a garment or a device and a method of providing a garment or device that is aesthetically pleasing and functional.

Moreover, an advantage of the present invention is to provide a garment or a device and a method of providing a garment or device that is easily secured to the body and includes readily accessible pockets associated therewith that maintain articles stored therein in a waterproof environment.

Additional features and advantages of the present invention are described in, and will be apparent from, the detailed description of the presently preferred embodiments and from the drawings.

BRIEF DESCRIPTION OF THE DRAWINGS

FIG. 4 illustrates a cross-sectional view taken generally along the line IV—IV of FIG. 3.

FIG. 10 illustrates a cross-sectional view generally taken along the line X—X of FIG. 8.

FIG. 14 illustrates a back view of a device illustrated in FIG. 13 having a pocket associated therewith for holding articles therein.

DETAILED DESCRIPTION OF THE PRESENTLY PREFERRED EMBODIMENTS

The present invention provides a garment, a device and a method for providing a garment or device that is particularly suitable for use in, for example, performing water-related activities, such as swimming, snorkeling, scuba diving, water-skiing, boating, surfing and other like sports and/or activities. Of course, the environment in which the garment or device is used is not restrictive of the present invention, and the garment may, of course, be used within any environment or for any activity.

The garment preferably includes at least one pocket that is zippered or otherwise fastened for access. The pocket is attached to the garment or device in a waterproof and watertight fashion such that an individual wearing the garment may carry articles that may typically not be exposed to water or are in danger of being damaged if exposure or contact with water occurs. Such articles include various types of electronics, generally portable, such as cellular telephones, pagers, electronic organizers, and the like. Of course, other articles, such as paper and money, for example, may also be carried within the pockets of the garment or device of the present invention without risking damage thereto.

Figure 1:
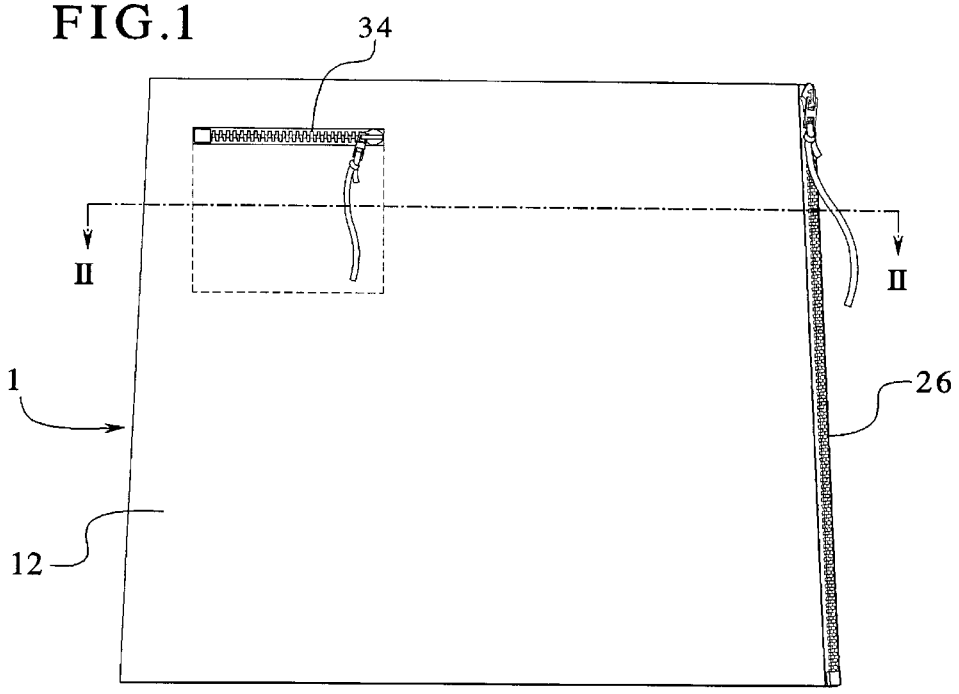
FIG. 1 illustrates a front view of a garment of the present invention having a pocket associated therewith for holding articles therein in a waterproof and watertight fashion.
Figure 2:
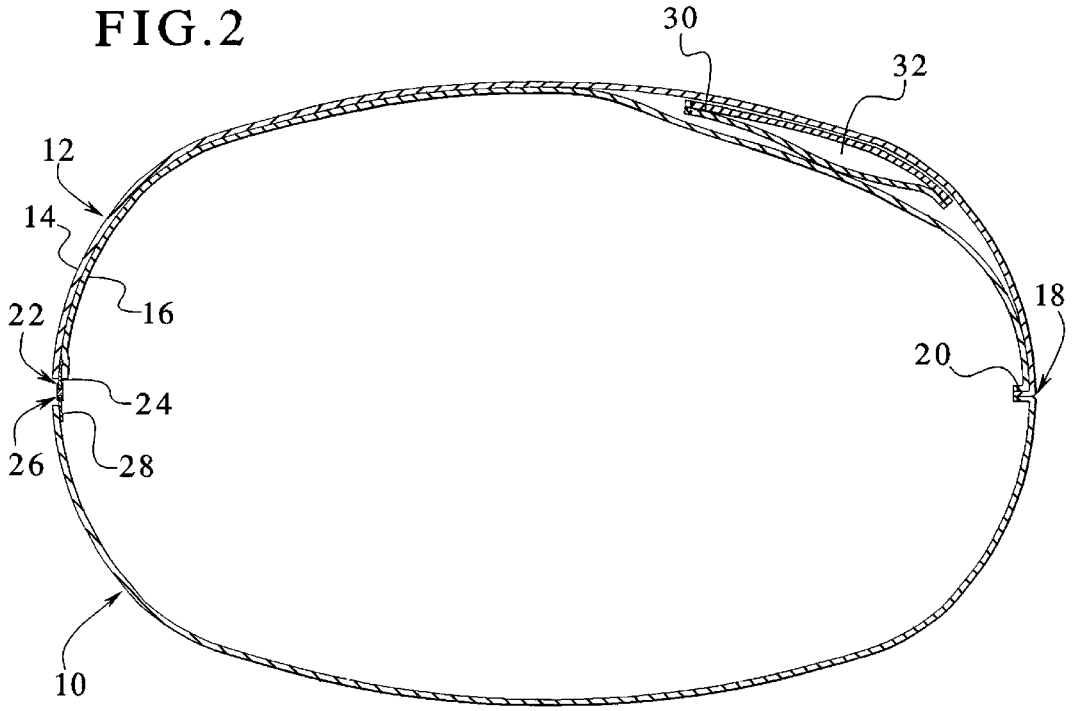
FIG. 2 illustrates a cross-sectional view taken generally along the line II—II of FIG. 1.

Referring now to the drawings wherein like numerals refer to like parts, FIG. 1 generally illustrates a garment 1 that may be worn, for example, as a skirt or otherwise secured around the waist of an individual, particularly suitable for use in an around the water. FIG. 2 illustrates a cross-sectional view of the garment 1 and more clearly illustrates a front side 10 and a back side 12 made form material, preferably neoprene. The back side 12 includes two layers: an outside layer 14 and an inside layer 16. The outside layer 14 and the inside layer 16 may be attached to the front side 10 of the garment 1 at one side 18 by, for example, a blind stitch 20.

On the opposite side 22 of the garment 1, the outside layer 14 and the inside layer 16 may be attached to one end 24 of a zipper 26 while the front side 10 may be attached to the other end 28 of the zipper 26. Of course, other fasteners may be implemented by those skilled in the art, such as, for example, matable hook and loop fasteners attached to the front side 10 and the back side 12 of the garment 1 and mating at the outside 22 of the garment 1 for securing the garment around, for example, the waist of an individual.

Between the outside layer 14 and the inside layer 16 is a pocket 30 having an interior compartment 32 accessible via a fastener, such as a zipper 34. The zipper 34 may be manufactured by Talon Corporation or YKK Corporation and is constructed, and manufactured to be waterproof and provide a watertight connection between the teeth of the zipper 34. Such zippers designed and constructed to be waterproof are generally known and available from at least one of Talon Corporation and YKK Corporation and are referred to as waterproof drysuit zippers. Such a zipper is shown and described with reference to FIG. 7. The zipper 34 and its attachment to the garment 1 provides access to the pocket 30 as well as the interior compartment 32 that is one-hundred percent waterproof and watertight allowing for articles to be placed in the interior compartment 32 of the pocket 30, such as electronic items, i.e. cellular telephones, pagers, personal electronic organizers, and the like, or other items such as paper and money, and other like articles generally not capable of being immersed or subjected to water therein, without concern for damage with respect thereto.

The garment 1 is preferably, as previously indicated, constructed from a material such as neoprene. Preferably, neoprene having a thickness of 3.0 mm is used as at least one ply of the garment 1. Further, preferably smooth skin neoprene is implemented, but a textured and/or patterned neoprene may also be used. Although the garment 1 is illustrated as a mini-type skirt, the garment 1 may take many shapes and sizes that are particularly suitable as a skirt or cover for women, in particular. The specific type of garment is not necessarily limited by the preset invention, but the specific attachment of the pocket 30 to the garment 1 including the zipper 34 necessary to maintain a one-hundred percent watertight and waterproof pocket for carrying articles that may generally not be exposed to or otherwise subjected to water is critical.

Figure 3:
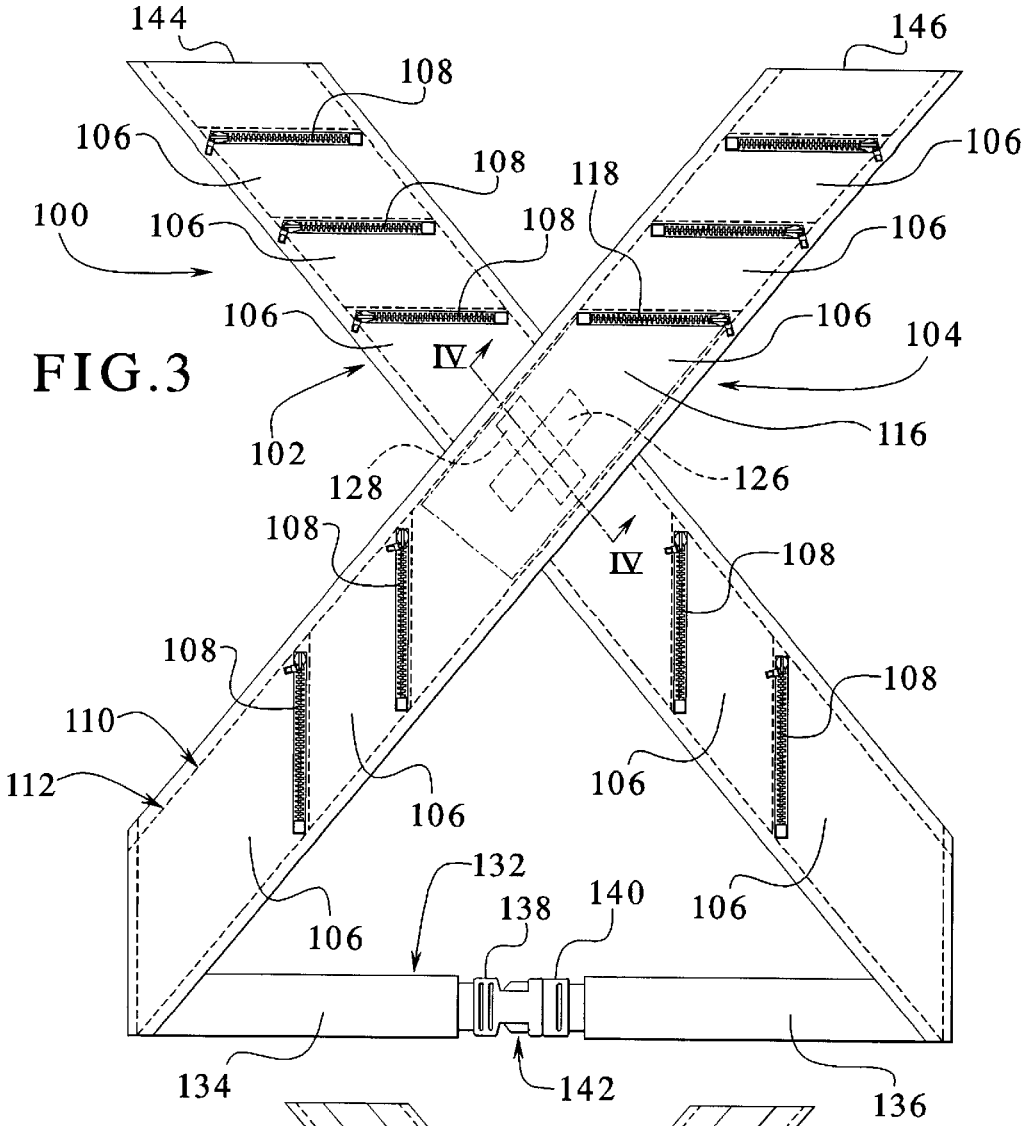
FIG. 3 illustrates a front view of an embodiment of a device of the present invention including multiple pockets associated therewith for holding articles therein.

Referring now to FIG. 3, a front view of another embodiment of a multi-pocketed strapped device 100 is illustrated. The device 100 is designed such that a first leg 102 and a second leg 104 of the device form an "X" that criss-cross one another and are placed across, for example, the front side, of a torso of an individual. The device 100 is preferably designed with a plurality of pockets 106 accessible via zippers 108 or other like fasteners generally known to those skilled in the art. Preferably, the first leg 102 and the second leg 104 are constructed of a material, such as neoprene. Layers 112,114 forming the legs 102 and 104 are preferably secured to one another by a stitching pattern 110 generally illustrated in FIG. 3. The top layer 112 may further be secured to the bottom layer 114 by an adhesive (not shown) that secures the two layers 112,114 between the outer periphery of the device 100 and the stitching pattern 110. Therefore, an adhesive and the stitching of the top layer 112 and the bottom layer 114 may secure the layers of the device 100 and create the pockets 106.

To this end, adjacent each of the zippers 108, a stitch is provided to define ends of the pockets 106. Therefore, when the zippers 108 are open and items are placed within the interiors of the pockets 106, articles may be capable of being maintained within the boundaries of the stitched area created by the stitching pattern 110 for the device 100. Preferably, the zippers 108 are waterproof and provide a watertight connection between the teeth of the zippers 108. Such zippers designed and constructed to be waterproof are generally known and available from at least one of Talon Corporation or YKK Corporation.

Another pocket 116 accessible via a zipper 118 is more clearly shown with reference to the cross-sectional view shown in FIG. 4. Further, the attachment of the first leg 102 to the second leg 104 is also more clearly illustrated in the cross-sectional view of FIG. 4. Still further, preferably, only the pocket 116 is created from an additional layer of material, preferably neoprene, secured to and accessible via the zipper 118.

As more clearly shown in FIG. 4, the top layer 112 is securable to the bottom layer 114 by the stitching pattern 110 around the periphery of the leg 104. Further, the pocket 116 having an interior 118 is provided as a one-hundred percent waterproof and watertight storage area for placing articles therein. The pocket 116 is also made from a material such as neoprene and includes a first layer 120 and a second layer 122 secured around its periphery by at least a stitch 124. The pocket 116 may also be provided with an adhesive securing the periphery and then the stitch 124. In addition, a polyurethane tape may heat-seal the periphery of the pocket 116.

Figure 5:
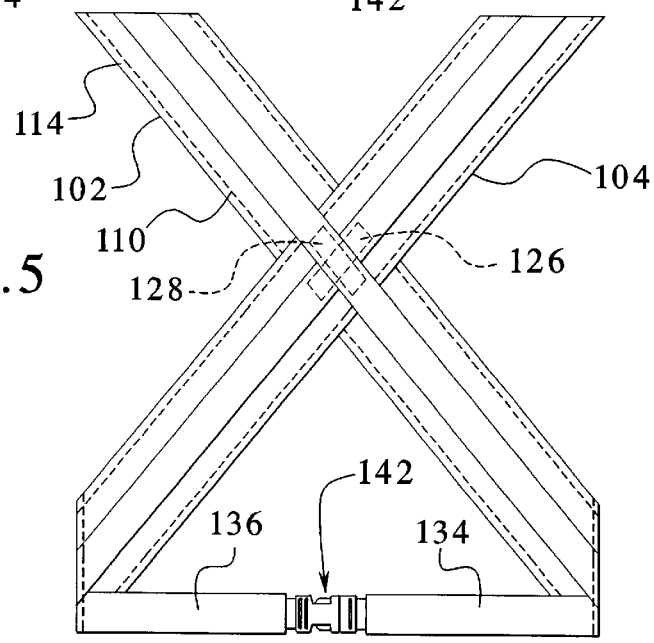
FIG. 5 illustrates a back view of an embodiment of the device generally illustrated in FIG. 3.

Attached to the bottom layer 114 of the second leg 104 is one portion of a fastener 126. Another portion of the fastener 128 is attached to a top layer 130 of the first leg 102. Preferably, the fasteners 126, 128 are complementary hook and loop fasteners. As illustrated in FIGS. 3 and 4, the fasteners 126, 128 are constructed and secured to their respective legs 102, 104 having a length to provide an adjustment factor for the crossing of the first leg 102 with the second leg 104. Accordingly, the sizing of the device 100 may be adjusted accordingly to a person wearing the device 100 based on the positioning of the fasteners 126, 128 along their respective lengths. Accordingly, the fasteners 126, 128 may not cross as shown in FIG. 3 and 5, but it is necessary for the fasteners 126, 128 to meet at some point along their lengths in order to secure the first leg 102 to the second leg 104 across the torso of the individual. The fasteners 126, 128 may be secured to the legs 104, 102, respectively, by an adhesive, by stitching or by any other well known means. The zipper 118 is secured to the pocket in a manner similar to that shown and described with reference to FIG. 7. As a result, a one-hundred percent waterproof and watertight compartment 118 is formed for placing therein articles that may not typically be subjected to or immersed in water.

As further illustrated in FIGS. 3 and 4, preferably, a strap 132 is provided having a first leg 134 connected to the second leg 104 of the device 100 and a second leg 136 connected to the first leg 102 of the device 100. Each of the first leg 134 and the second leg 136 is attached to respective ends 138, 140 of a fastener 142, such as a buckle generally known to those skilled in the art. The buckle 142 may also be adjustable to account for various sizes and the like, and may further be selectively releasable by separating the ends 138, 140. Preferably, the strap 132 is secured near or at the waist of an individual on the back side of the individual, and the legs 102, 104 are placed around the front side of the individual with ends 144, 146 placed over the shoulders of the individual. The legs 134,136 of the strap 132 may be constructed from a single ply of material such as neoprene; however, of course, other materials may be implemented by those skilled in the art. The first leg 134 and the second leg 136 are preferably attached to the legs 102, 104 of the device 100 by suitable stitching and/or adhesive as may be required.

Figure 6:
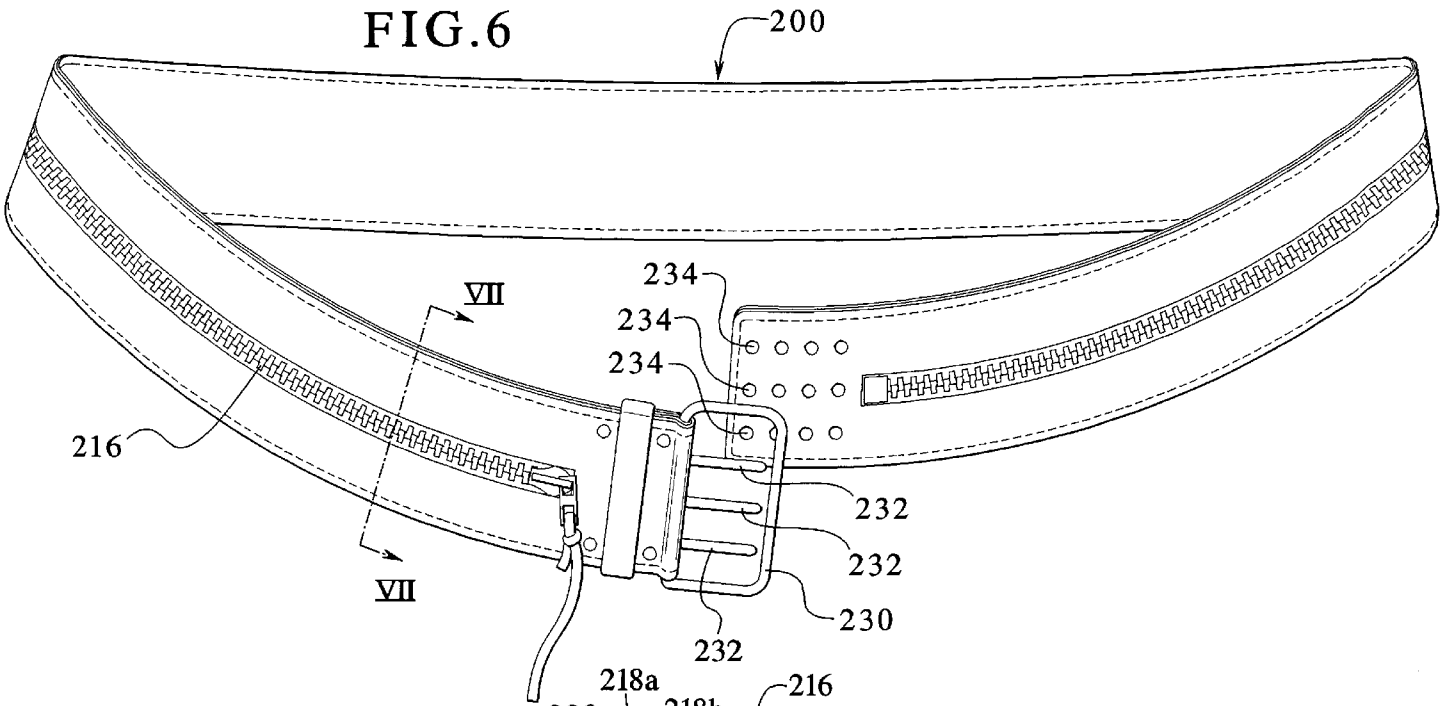
FIG. 6 illustrates a perspective view of an embodiment of a device of the present invention having a pocket associated therewith for holding articles therein in a waterproof and watertight fashion.
Figure 7:
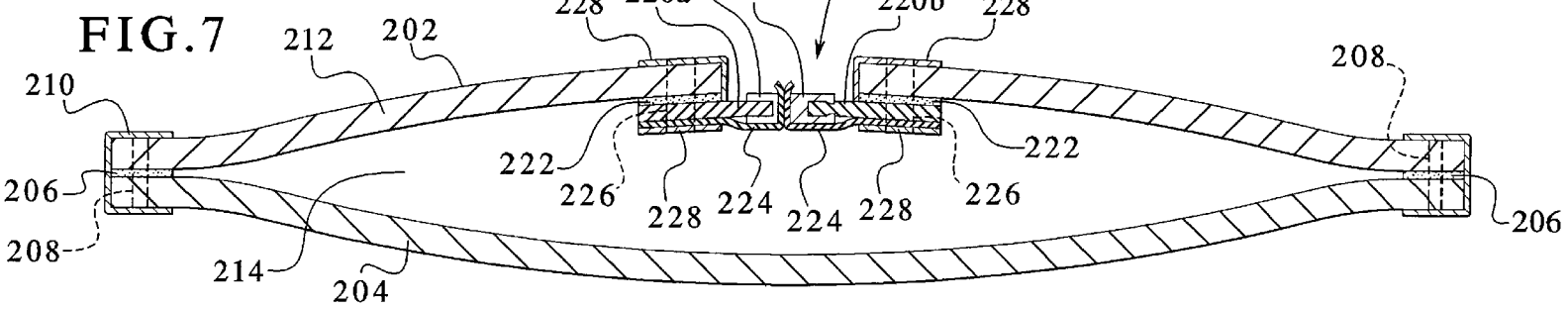
FIG. 7 illustrates a cross-sectional view taken generally along the line VII—VII of FIG. 6.

Referring now to FIGS. 6 and 7, another embodiment of a device 200 is generally illustrated. The device 200 is a belt-like configuration preferably constructed from a first layer 202 and a second layer 204 of a material, preferably neoprene. The first layer 202 and the second layer 204 are preferably secured around its periphery by an adhesive 206 and then a stitch 208 as generally shown in FIG. 7. Finally, a heat sealable polyurethane tape 210 may be heat-sealed around the periphery of the device 200. As a result, a pocket 212 having an interior compartment 214 is provided and accessible via a fastener, such as a zipper 216.

The specific attachment of the zipper 216 is clearly illustrated in FIG. 7. As previously set forth, such zippers are known and available from Talon Corporation or YKK Corporation. The zipper 216 includes teeth 218*a*, 218*b* that are attached to ends 220*a*, 220*b*, respectively. The ends 220*a*, 220*b* are preferably made from rubber and may be attached between the first layer 202 of the pocket 212 by an adhesive 222. Attached to each of the ends 220*a*, 220*b* is a flap 224, also preferably made from rubber. The flaps 224 as shown are attached in a known manner to the ends 220*a*, 220*b*. However, the flaps 224 may be integrally connected to the ends 220*a*, 220*b*. The flaps 224 feed into the teeth 218*a*,

218*b* of the zipper 216 creating complete waterproofness in a zipped position of the zipper 216. A stitch 226 secures the ends 220*a*, 220*b* and the flaps 224 to the first layer 202 after securing the same via the adhesive 222. In addition, a polyurethane tape may be heat-sealed to the first layer and to the zipper 216 thereby ensuring one-hundred percent waterproofness at all points at which the zipper 216 attaches to the first layer 202 of the device 200.

Preferably, the adhesive 222 and the adhesive 206 is used at all junctions and is preferably triple-glued externally, such gluing process being generally known in the art. Then, at the point at which the adhesive 206, 222 may be applied to the device 200, a Mauser-lock sewn blind stitch 208, 226 is applied through the appropriate layers of the device as generally designated by the dashed lines in FIG. 7. Finally, a polyurethane tape 210, 228 may then be applied by heat-sealing to cover all seams and stitched meeting points thereby ensuring waterproofness at the points at which the adhesives 206, 222 are applied to the device 200. The heat sealable polyurethane tape provides a final step to ensure complete waterproofness at all seams following application of the adhesive and the stitching, if necessary.

The process shown and described with reference to the seams and application of the zippers to the garments or devices may be applicable to any of the garments or devices illustrated in any of the embodiments illustrated with reference to FIGS. 1–14.

As further shown in FIG. 6, a buckle 230 having prongs 232 that feed into holes 234 is also provided for securing the device 200 around, for example, the waist of an individual. Of course, other known fasteners may be implemented by those skilled in the art in place of the buckle 230, the prongs 232 and corresponding holes 234.

Figure 9:
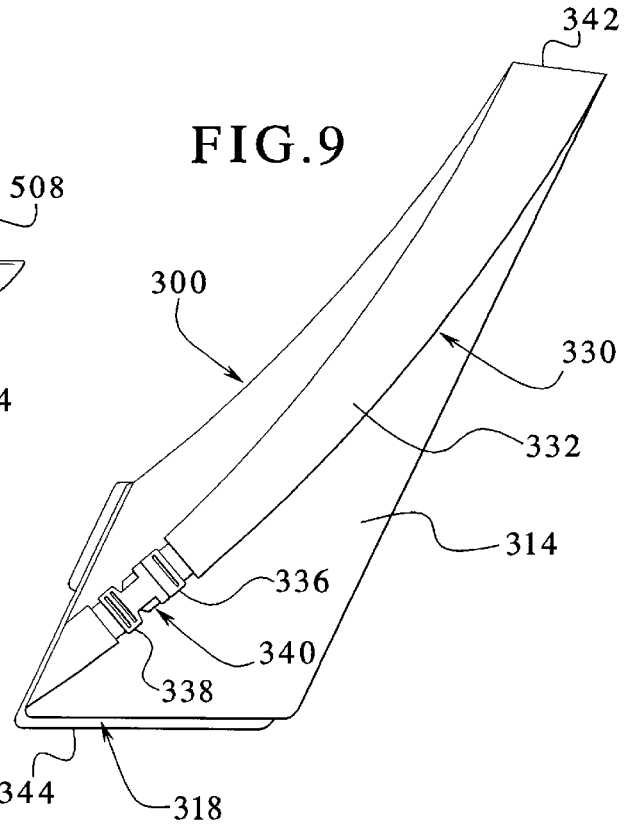
FIG. 9 illustrates a back view of a device of an embodiment of the present invention illustrated in FIG. 8.
Figure 8:
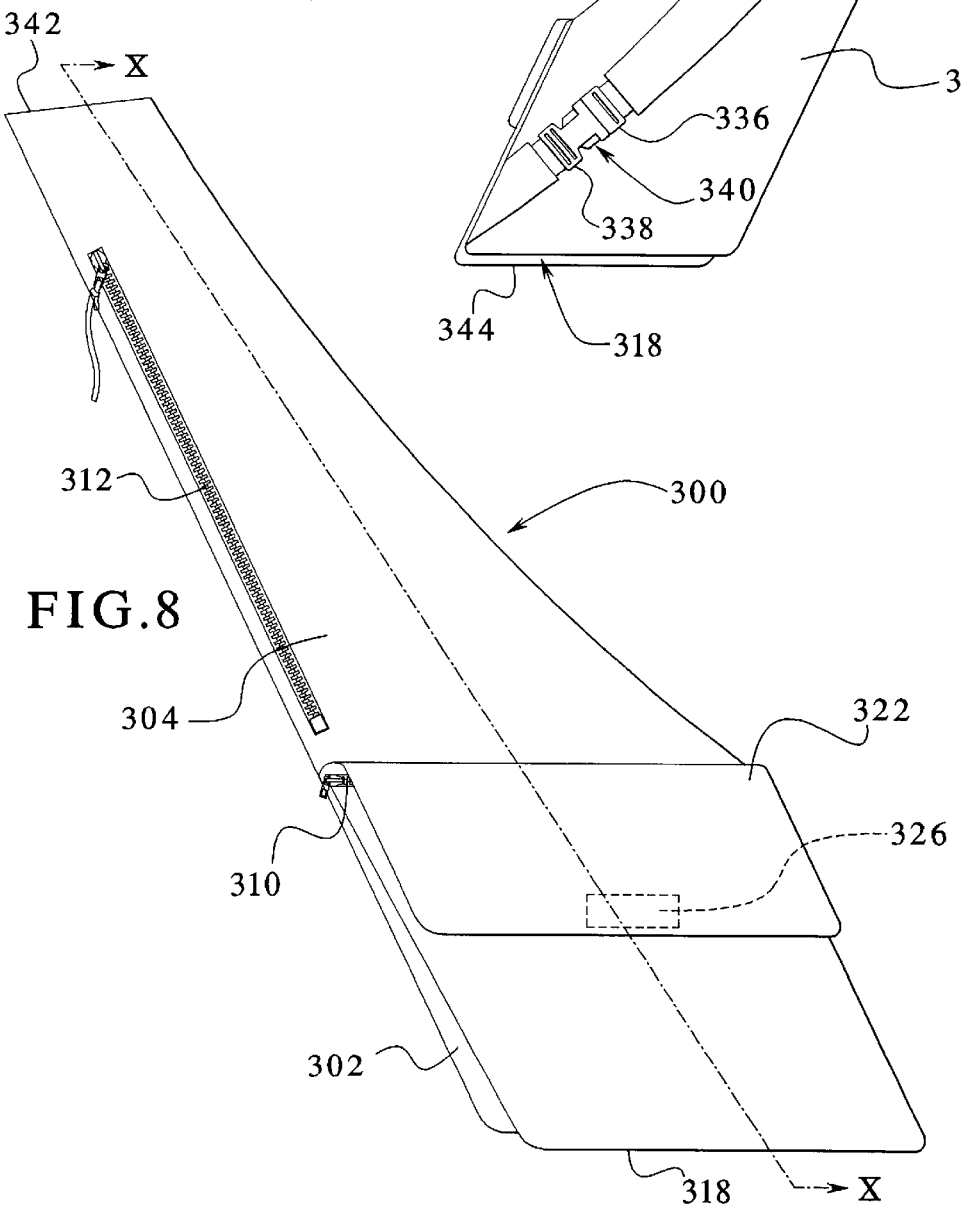
FIG. 8 illustrates a front view of a device of an embodiment of the present invention having pockets associated therewith for holding articles therein.

Referring now to FIGS. 8–10, another embodiment of a device 300 is generally illustrated. The device 300 is a strapped sash having accessible waterproof pockets 302, 304 defining interior compartments 306, 208 accessible by fasteners, preferably zippers 310, 312, respectively. The device 300 is preferably constructed from a back layer 314 and a front layer 316 of material, preferably neoprene. At one end 318, the back layer 314 is secured to the front layer 316 by a gusset 320. The gusset 320 may be a separate or integrally formed piece of material providing depth for the interior compartment 306 of the pocket 302. The end 318 may be attached by an adhesive and/or stitching and/or polyurethane tape as previously shown and described with reference to FIG. 7.

The front layer 316 may be non-contiguous and separated by a flap 322 covering the access area 324 created by the zipper 310 of the pocket 302. The flap 322 may also be adhered and/or stitched and/or taped as described with reference to FIG. 7. The flap 324 may further be provided with a fastener 326 that is matably attachable to a fastener 328. Preferably, the fasteners 326, 328 are complementary hook and loop fasteners securable as shown in FIG. 10.

The back layer 314, as shown in FIG. 9, is attachable to a strap 330. The strap 330 is similar to that shown and described with reference to FIGS. 3 and 5 and similar to that which will be described with reference to FIG. 11. The strap includes a first leg 332 and a second leg 334 each connected to respective ends 336, 338 of an adjustable fastener 340, such as a matable buckle. The device 300 is preferably worn as, for example, a sash, that extends across, a front torso of an individual, and the strap 332 attaches across the back side of the individual. One end 342 is preferably extendable around a shoulder with the opposite end 318 at or near the waist of an individual.

Figure 12:
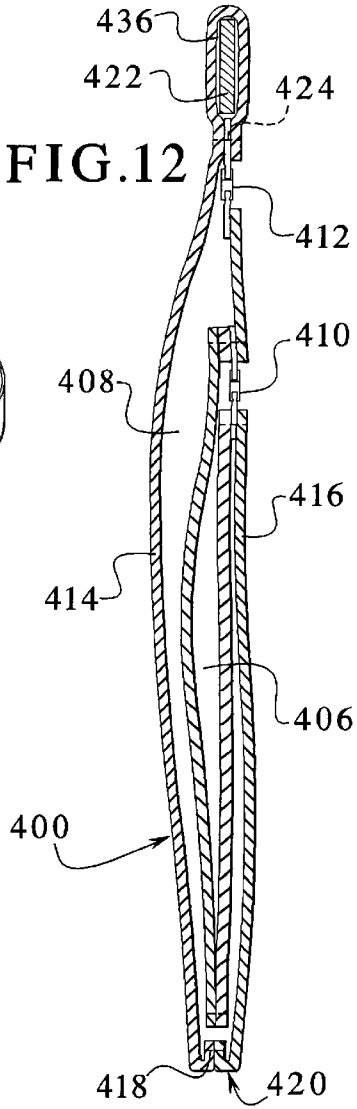
FIG. 12 illustrates a cross-sectional view generally taken along the line XII—XII of FIG. 11.
Figure 11:
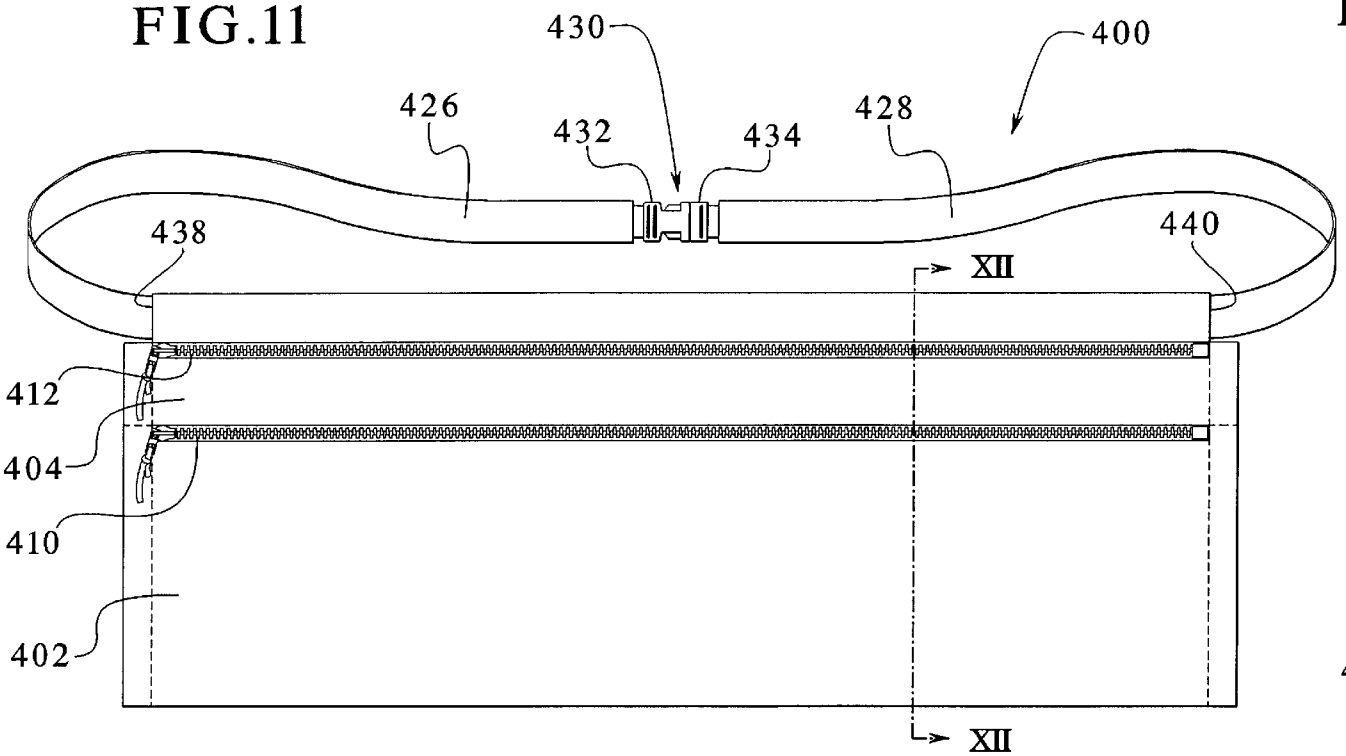
FIG. 11 illustrates a front view of another embodiment of a device of the present invention having pockets associated therewith for holding articles therein.

Referring now to FIGS. 11 and 12, another embodiment of a device 400 is illustrated. The device 400 includes pockets 402, 404 having compartments 406, 408, respectively. The compartments 406, 408 are accessible via fasteners, such as zippers 410, 412, respectively. Preferably, the zippers 410, 412 are attached as shown and described with reference to FIG. 7, creating waterproof and watertight compartments 406, 408 in which articles not generally capable of being exposed to or immersed in water to be stored therein. The zippers 410, 412 may be adhered and/or stitched and/or taped and heat-sealed by the process shown and described with reference to FIG. 7.

The device 400 includes a front layer 414 and a back layer 416 that is secured one layer to the other by a blind stitch 418 at one end 420. At an opposite end, the front layer 414 extends around a strap 422. The front layer 414 extends around the strap 422, and a stitch 424 may secure the end of the front layer to the opposite side of the front layer 414 and to the zipper 412. The zipper 412 provides access to the compartment 408; and the zipper 410 provides access to the compartment 406.

The strap 422 preferably includes a first leg 426 attachable to a second leg 428 that is securable by a fastener 430 having complementary matable ends 432, 434, such as an adjustable buckle. The strap 422 may extend entirely through the opening 436 created by the extension of the front layer 414; alternatively, the strap 42 may be stitched or otherwise attached at opposite ends 438, 440 of the front layer 414 at the opening 436 created at the ends 438, 440. The device 400 is designed to be adjusted and secured, for example, around a waist of an individual. The front layer 414 and the back layer 416 may be adhered and/or stitched and/or taped as shown and described with reference to the device shown in FIG. 7.

Figure 13:
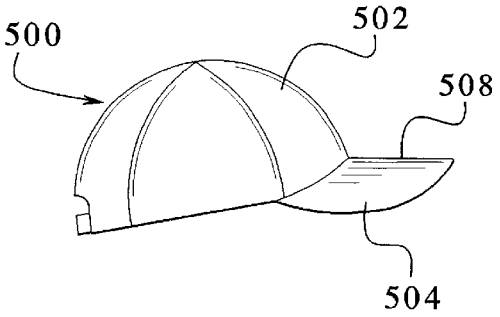
FIG. 13 illustrates a side view of another embodiment of a device of the present invention.

Referring now to FIGS. 13 and 14, another embodiment of a device 500 is generally illustrated. The device 500 is a cap that is generally worn on the head of an individual. The device 500 is preferably constructed to have a portion 502 that partially covers the head of an individual wearing the device 500 and a bill portion 504 that preferably extends in a direction away from a person's head and generally acts, for example, as a visor or shading mechanism for the eyes, for example, of the person wearing the device 500.

On the underside of the bill portion 504 is a fastener, preferably a zipper 506, providing access to an interior compartment formed between a top layer 508 and a bottom layer 510 of the bill portion 504. A stitch 512 preferably extends around at least a portion of the periphery of the bill portion 504 attaching the top layer 508 to the bottom layer 510. The top layer 508 and the bottom layer 510 are preferably made from a material, such as neoprene, and may be adhered and/or stitched and/or taped with a heat-sealable tape as shown and described with reference to FIG. 7. Likewise, the zipper 506 may be attached to the bottom layer 510 of the bill portion 504 in the manner shown and described with reference to FIG. 7. As a result, a pocket 514 is created between the top layer 508 and the bottom layer 510 accessible via the zipper 506. With the zipper 506 attached as shown and described with reference to FIG. 7, a complete one-hundred percent waterproof pocket 514 is provided and associated with the device 500.

Although the device 500 is generally shown as a billed, baseball-type cap, many other embodiments of a cap-like structure that are securable around the head of an individual may be implemented. Further, the bill portion 504 is constructed of neoprene material and adhered and/or stitched and/or taped with the zipper similarly attached thereto creating a waterproof and watertight pocket in the bill potion of the device 500.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A strapped device for carrying articles, the device comprising:

a body defining a length between a first end and a second end wherein the body is constructed of at least a first layer and a second layer of material wherein the first layer and the second layer are secured substantially around their peripheries such that a water resistant seal is formed between the first layer and the second layer and such that an interior compartment is created between the first layer and the second layer inside the peripherally secured area and further wherein the first layer and the second layer are secured to each other by an adhesive, a stitch and heat-sealable tape; and a fastener attached to the first layer providing selective access to the interior compartment wherein the interior compartment is waterproof and watertight when the fastener is in a closed position.

2. The strapped device of claim 1 further comprising:

a strap attached to each of the first end and the second end of the body wherein each of the straps has one portion of a complementary matable fastener.

3. The strapped device of claim 1 further comprising:

a second interior compartment between the first layer and the second layer of the body; and a second fastener providing selective access to the second interior compartment.

4. The strapped device of claim 1 wherein the first layer and the second layer are constructed from neoprene.

5. A strapped device for carrying articles, the device comprising:

a body defining a length between a first end and a second end wherein the body is constructed of at least a first layer and a second layer of material wherein the first layer and the second layer are secured substantially around their peripheries such that a water resistant seal is formed between the first layer and the second layer and such that an interior compartment is created between the first layer and the second layer inside the peripherally secured area; and a fastener attached to the first layer providing selective access to the interior compartment wherein the interior compartment is waterproof and watertight when the fastener is in a closed position and further wherein the fastener is attached to the first layer by an adhesive, a stitch and heat-sealable tape.

6. The strapped device of claim 5 further comprising:

a strap attached to each of the first end and the second end of the body wherein each of the straps has one portion of a complementary matable fastener.

7. The strapped device of claim 5 further comprising:

a second interior compartment between the first layer and the second layer of the body; and a second fastener providing selective access to the second interior compartment.

8. The strapped device of claim 5 wherein the first layer and the second layer are constructed from neoprene.

9. The strapped device of claim 5 wherein the first layer and the second layer are secured to each other by an adhesive, a stitch and heat-sealable tape.

* * * * *